US006637594B1

(12) United States Patent
Bucknell

(10) Patent No.: US 6,637,594 B1
(45) Date of Patent: Oct. 28, 2003

(54) POP UP BROCHURE DISPLAY/PRODUCT DISPENSING UNIT

(75) Inventor: Michael Charles Bucknell, Dee Why (AU)

(73) Assignee: Adze Pty. Ltd., Dee Why (AU)

( * ) Notice: Subject to any disclaimer, the term of this patent is extended or adjusted under 35 U.S.C. 154(b) by 0 days.

(21) Appl. No.: 10/209,821

(22) Filed: Jul. 22, 2002

Related U.S. Application Data

(63) Continuation-in-part of application No. 29/136,376, filed on Jan. 29, 2001, now abandoned.

(51) Int. Cl.[7] ..... B65D 85/00
(52) U.S. Cl. ..... 206/425; 206/764
(58) Field of Search ..... 206/45.25, 45.27, 206/424, 425, 494, 557, 764, 765, 768, 774; 40/124.14, 124.16, 124.19, 124.06, 124.08, 750, 751, 789; 248/150, 152, 441.1, 459; D19/91; D9/339

(56) References Cited

U.S. PATENT DOCUMENTS

| | | | | | |
|---|---|---|---|---|---|
| 1,916,230 | A | | 7/1933 | Murray | |
| 1,940,010 | A | | 12/1933 | Murray | |
| 2,730,231 | A | | 1/1956 | Ryan | |
| 3,093,240 | A | * | 6/1963 | Donahue et al. | 206/765 |
| D249,123 | S | | 8/1978 | Dogliotti | |
| D274,407 | S | | 6/1984 | Rosenburg, Jr. | |
| 5,690,213 | A | * | 11/1997 | Matsumura | 206/45.21 |
| 5,711,101 | A | * | 1/1998 | Mueller et al. | 40/750 |
| 5,782,357 | A | * | 7/1998 | Johnson | 206/461 |
| 5,823,393 | A | | 10/1998 | Hafstrom | |
| 5,860,526 | A | | 1/1999 | Burke, Jr. | |
| 5,901,844 | A | * | 5/1999 | Gambardella et al. | 206/308.1 |

* cited by examiner

*Primary Examiner*—Luan K. Bui
(74) *Attorney, Agent, or Firm*—Sheridan Ross PC

(57) ABSTRACT

This invention is concerned with display units made by folding blanks cut from cardboard, or other flat material, into three-dimensional forms. In particular, the invention provides a brochure display unit, a gravity-fed product dispensing unit and an alternative gravity-fed product dispensing unit featuring an internal false bottom. There is provided the preferred shape of each of the at least two blanks required to form the display units. There is also provided the methods of assembling the finished units from each of the given blanks. The invention features a unique multi-piece construction that minimises the amount of waste material created whilst cutting the blanks from the material sheet; a method of construction that allows the units to be assembled with a minimum of skilled labour and exposure by that labour to potentially dangerous hot gluing operations; and allows the partially assembled units to be transported in a collapsed, or 'flat', state and erected quickly and easily once in position for use.

18 Claims, 11 Drawing Sheets

POP UP BROCHURE DISPLAY/PRODUCT DISPENSING UNIT

CROSS REFERENCE TO RELATED APPLICATIONS

This patent is a continuation-in-part of, and priority is claimed from, U.S. Pat. Ser. No. 29/136,376, filed Jan. 29, 2001 entitled "POP UP BROCHURE HOLDER," the entire disclosure of which is incorporated by reference herein.

FIELD OF THE INVENTION

This invention relates to improvements in user-erectable ('pop-up'), stand-alone containers that are constructed of cardboard or similar materials, that may be pre-packed for shipping and subsequently used to display brochures or to dispense packaged products at point of purchase.

BACKGROUND TO THE INVENTION

There are currently a number of brochure holders and product dispensers made of plastic and similar materials on the market. There are also a number of variations of cardboard pop-up brochure display packs available, as well as cardboard pop-up gravity-fed dispensing packs.

Current cardboard pop-up brochure display and product dispensing units have an advantage over similar units constructed of plastic due to their ability to be economically printed in full colour over their entire surface, thus enhancing the point of purchase advertising appeal.

However, the main reason that cardboard units have not exceeded the market penetration of traditional plastic brochure holders or product dispensers is due to the high cost of their manufacture and assembly.

Current cardboard units are generally manufactured from a single piece blank of complex shape, thereby using a relatively large area of cardboard sheet. This tends to result in excessive wastage of material.

Assembly of the unit from the blank is a slow and predominantly manual process requiring skilled operators using potentially dangerous hot-melt glue, or expensive double-sided tape, to assemble each unit. As with any manual gluing operation, there is a potential that quality problems in the gluing operation may not be detected until the unit has been in service for some time.

In addition, using hot manual application equipment and very hot glue streams gives rise to Occupational Health and Safety (OH&S) issues for assemblers, adding to the cost of assembly.

Once assembled, current units in their unfilled state cannot be 'flattened', so they occupy a large unit volume. Therefore, attendant storage costs add to the expense of pre-making large quantities of these units.

The object of the present invention is to provide a design and method for manufacturing 'pop-up' brochure holders and/or product dispensing units that reduces the waste involved in manufacturing blanks, eliminates the need to use expensive and/or dangerous methods of erection and allows the units to be transported or stored in a flattened state and easily erected at the intended point of dispensing.

SUMMARY OF THE INVENTION

The present invention overcomes the shortcomings of current versions of cardboard pop-up brochure display and product dispensing units by:

(a) providing a construction configuration based on two blanks, that, when cut from one piece or two single pieces of cardboard, may use a lesser amount of material than configurations based on a single blank, consequently minimising wastage;

(b) providing improvements to mechanisms of erection currently used in these forms of packaging; and (c) providing a different method of manufacture and assembly to that of conventional units.

The present invention's configuration enables the use of available machinery to manufacture the pop-up units as two components, rather than die cutting a single blank requiring further manufacture.

More specifically, the invention provides a display unit for displaying and/or dispensing items, including a sleeve part and a container part, wherein:

(a) said sleeve part is formed from a first shaped blank of card or other flat material and by folding about four substantially parallel first fold lines is movable between a first condition in which said sleeve part defines a sleeve of rectangular cross section in a plane perpendicular to said first fold lines and a second condition in which said sleeve part lies at least approximately flat;

(b) said container part is formed from a second shaped blank of card or other flat material and by folding about four substantially parallel second fold lines is movable between a first condition in which said container part at least partially defines a container of rectangular cross section in a plane perpendicular to said second fold lines and a second condition in which said sleeve part lies at least approximately flat;

(c) said sleeve part is slideable within said container part in a sliding direction parallel to said first and second fold lines, at least in said first condition of said sleeve part and said first condition of said container part;

(d) said sleeve part and said container part are secured to each other by connecting means so that when said container part is slid by a user in said sliding direction within said sleeve part, sections of said sleeve part are folded about further fold lines in said sleeve part and said sections define protruding feet of said sleeve part.

Other aspects of the invention are disclosed in the appended claims.

One of the components, an outer sleeve, is conventionally die cut and creased. It is then glued in-line to form a sleeve with tabbed or straight extensions. The other component, an inner base/pocket, is also conventionally die cut and creased then glued in-line to form a box with e.g. a crash-lock bottom; a folded bottom; a snap-lock bottom, or optionally any other type of bottom. Both components may be shipped flat so they occupy a minimum of space in transport and/or storage.

Final assembly simply involves slipping the outer sleeve over the base and inserting locking tabs into corresponding slots. This operation may be undertaken by unskilled labour. It can be done at the manufacture stage, so that the entire unit is shipped in a form ready to simply "pop up" on site, or the base and sleeve may be shipped and stored separately and only brought together when they are to be erected for use.

In another embodiment of the invention, there exists an alternative to the above-described 'tab and slot' method of connecting the outer sleeve to the inner box. The alternative method is to glue the ends of the outer sleeve extensions to the front and back of the inner box, either by hand or machine, as part of a combined manufacturing and assembly procedure. There are various configurations possible for this, as shown in FIGS. 21 and 22.

If the units are to be filled with brochures or product, the pack can be snapped open, the crash-lock bottom, snap-lock, or folding bottom, holding the unit in the erected position. If the units are to be filled later or shipped to another location for filling, they can be left unopened so they lie flat for efficient transport.

Another embodiment of the invention, as applied to the dispensing application, may use an alternative to the crash-lock, or snap-lock, bottom combined with a base insert piece. This alternative features an extended flap that is folded up during assembly inside the bottom of the inner box to form a false bottom at the correct height for sliding the product out of the dispensing slot. Other flaps in the base may also aid in securing all panels in place. Also disclosed is an improvement to a crash-lock or snap-lock bottom construction, usable with the invention to enhance its resistance to loss of contents.

Once erected at point of dispensing, location tabs in the front and back of the outer sleeve engage with corresponding slots in the inner base/pocket, providing extensions which give stability and prevent the units from collapsing when displayed.

Enhancements can be made to accommodate variations to the brochure or product that is to be contained in the display unit. For example, the brochure display unit may feature a window cut out of the front to display a picture on the brochure; or it might have a 'cut-down' front to reveal more of the brochure.

In another embodiment of the invention, the dispensing unit might be required to dispense two or more different products side by side. In this case, dividers may be used to separate the products. Alternatively, product may be dispensed from front and back of the unit simultaneously, or from two different levels simultaneously. This may be achieved with insert spacers in both the horizontal and vertical planes.

BRIEF DESCRIPTION OF THE DRAWINGS

Reference will now be made to the accompanying drawings. The drawings explain the unique configurations and relative dimensions that form the basis of the invention.

DESCRIPTION OF EMBODIMENTS OF THE INVENTION

Figure 1:
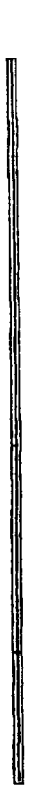
FIG. 1 is an edge (side) elevation of an assembled brochure display unit according to the invention in a flattened state.
Figure 2:
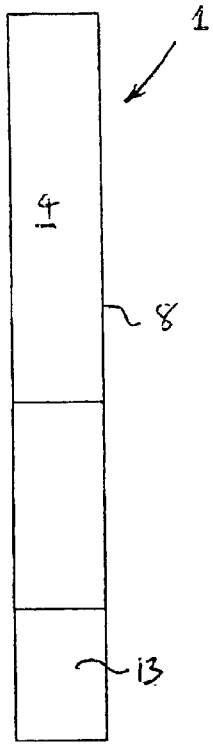
FIG. 2 is a side elevation of the brochure display unit of FIG. 1 in a partially erected condition.
Figure 3:
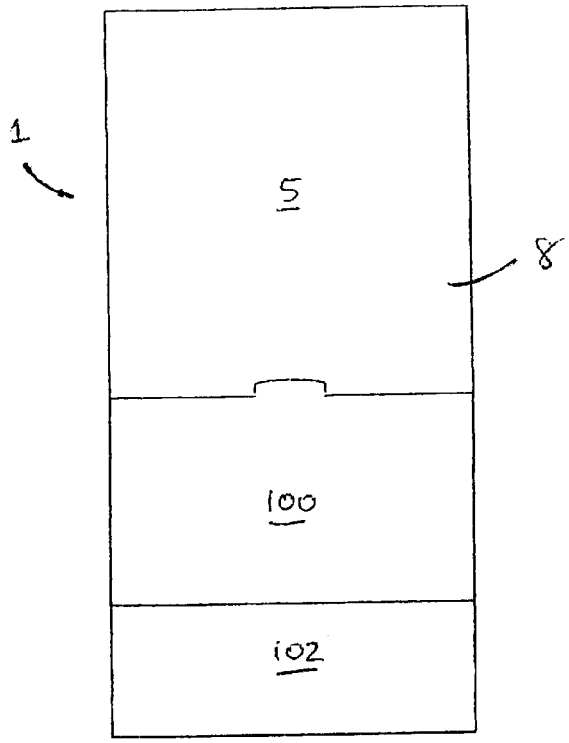
FIG. 3 is a front elevation of the brochure display unit of FIG. 2 in a partially erected condition.
Figure 4:
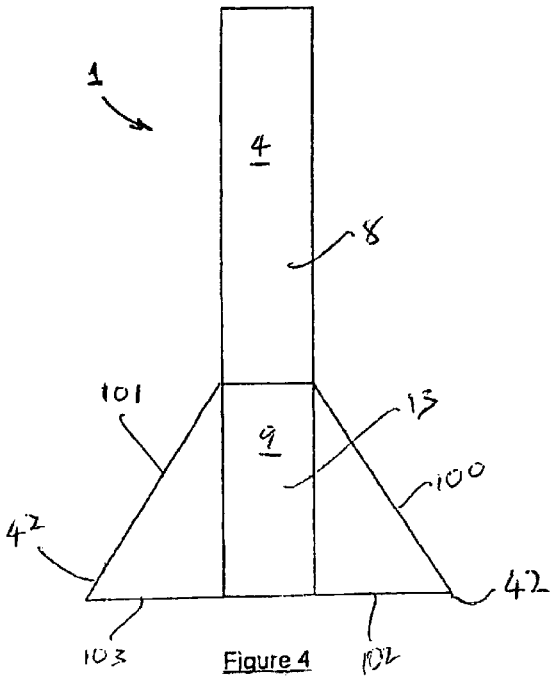
FIG. 4 is a side elevation of the brochure display unit of FIG. 1, in a fully erected condition.
Figure 5:
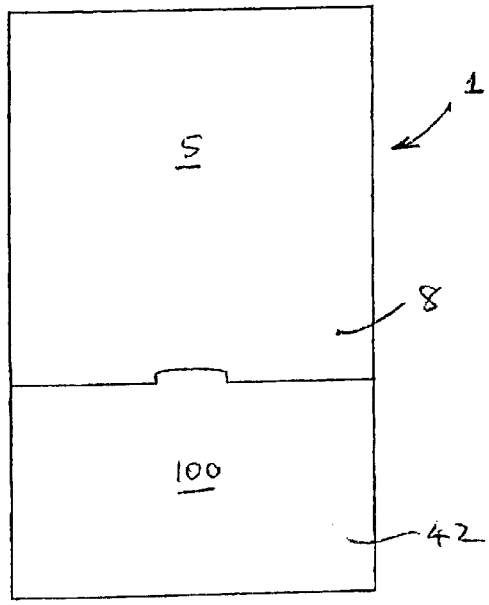
FIG. 5 is a front elevation of the fully erected brochure display unit of FIG. 4.
Figure 6:
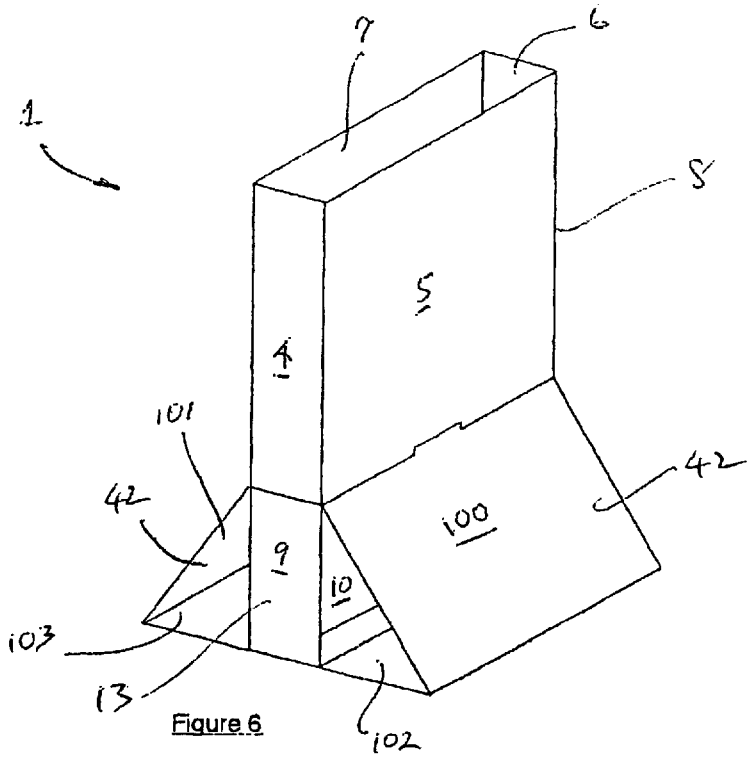
FIG. 6 is an isometric view of the erected brochure display unit of FIG. 4.
Figure 7:
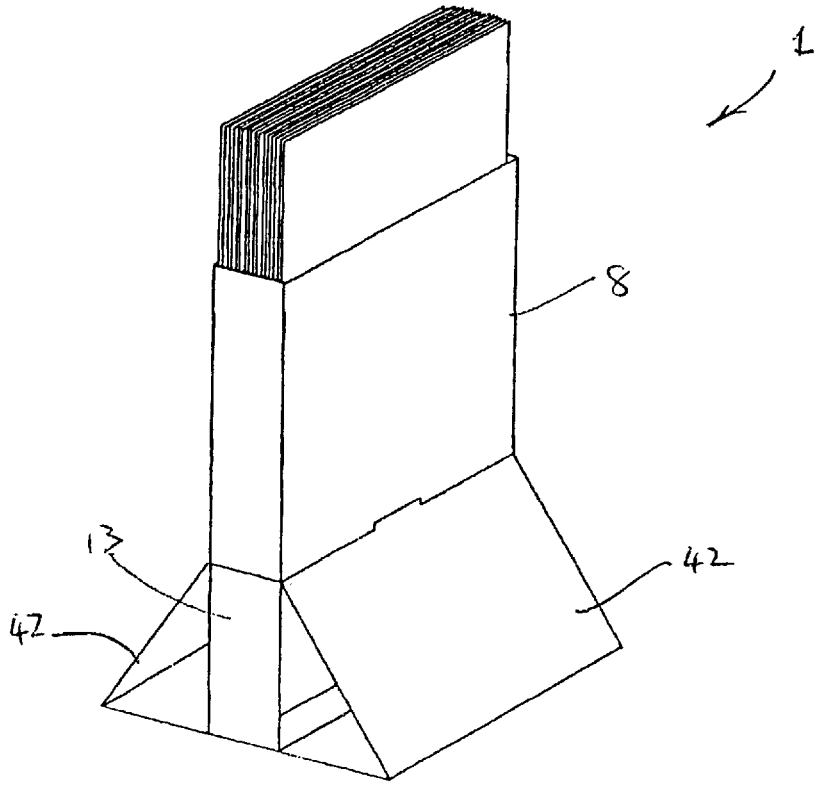
FIG. 7 is an isometric view of the erected brochure display unit of FIG. 4, when filled with brochures.

A pop-up brochure display unit 1 according to the invention will be described first. FIGS. 1 to 7 show various views of the unit 1, from its initially-assembled and collapsed flat state (shown in FIG. 1) to fully erected (shown in FIGS. 6 and 7, which are isometric views of the erected brochure display unit 1 both empty, and filled with brochures). It can be seen from FIG. 1 that the collapsed flat unit 1 takes up very little space. FIG. 2 shows the unit 1, in a partly-erected condition, side-on and FIG. 3 shows the partly-erected unit 1 front-on. FIG. 4 is a side view of the fully erected unit 1 and FIG. 5 shows it from the front.

Figure 8:
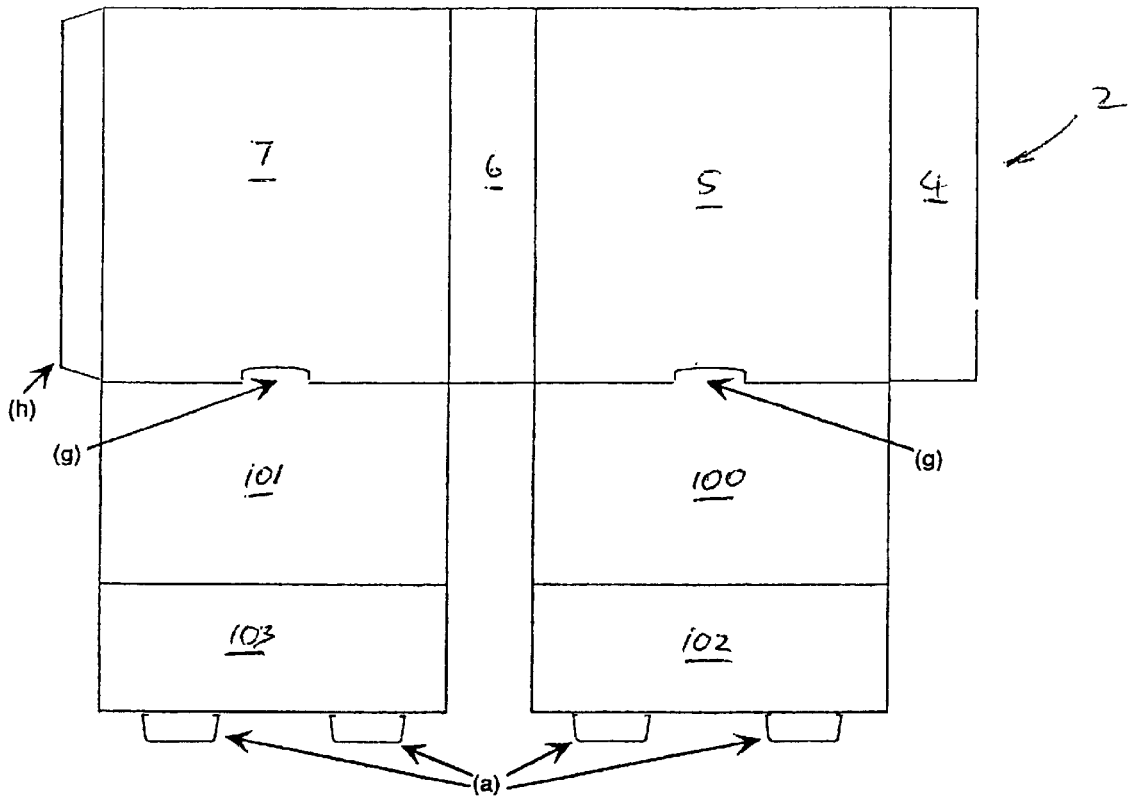
FIG. 8 is an elevation of an outer sleeve blank for the pop-up brochure display unit of FIG. 1, shown unfolded.

The unit 1 has two parts, namely an outer sleeve 8 formed from a blank 2 and an inner base 13 formed from a blank 3, which are both made from flat cardboard. (It should be understood that other flat, foldable materials may be used and are within the scope of the invention.) FIG. 8 shows the outer sleeve blank 2 for the pop-up brochure display unit 1, and FIG. 9 the inner base blank 3. When outer sleeve blank 2 has been formed, glue flap (h) is glued to section 4 so that on erection of the unit 1, sections 4, 5, 6 and 7 form sides of outer sleeve 8. Locking tabs (a) insert during initial assembly into slots (b) of inner base blank 3, shown in FIG. 9. Also shown in FIG. 8 are location tabs (g) which, when the unit 1 is erected, locate in slots (f) in the inner base blank 3.

Figure 9:
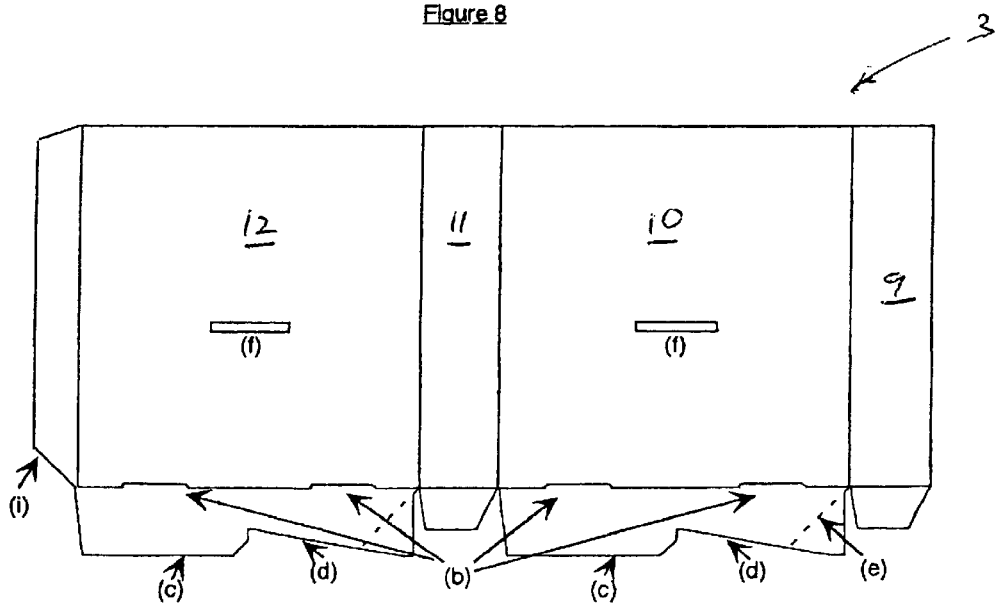
FIG. 9 is an elevation of a bottom inner base blank for the pop-up brochure display unit of FIG. 1, shown unfolded.

FIG. 9 shows the inner base blank 3, with a glue flap (i) which is glued, when the blank 3 has been formed, to section 9 so that on erection of the unit 1, sections 9, 10, 11 and 12 form sides of inner base 13. Blank 3 is formed so as, on assembly, to provide a bottom of the crash-lock type, such as is known to persons skilled in the art. Shown also in FIG. 9 is a wide (maximum width) flap (c) for added strength, and an angled cut (d) which allows for a wider-than-usual, and therefore stronger, hinge mechanism (e) as well as a general strengthening to this bottom area. (Conventional crash-lock bottom designs use a straight horizontal cut at (d) (i.e. one which would in this case extend parallel to the edges marked (c)) so that, in a shallow but wide box, there is a tendency for longitudinal weakness which can result in product falling through the bottom of the box).

When the blanks 2 and 3 have been formed and flaps (h) and (i) glued in their respective positions, they are assembled together with the inner base 13 inside outer sleeve 8, tabs (a) located in slots (b) and the flaps (c) between sections 10 and 12. At this stage, the sleeve 8 and the inner base 13 can lie flat as shown in FIG. 1, for convenient transport. When the unit 1 is to be readied for use, outer edges of the flattened assembly (i.e. unit 1) are pushed together, so that the inner base 13 assumes an open-topped box shape, and the sleeve 8 surrounds it. At this stage, shown in FIGS. 2 and 3, the crash-lock bottom is automatically formed, as known in the art. To finally erect the unit 1, the inner base unit 13 is pushed upwards within the sleeve 8, until tabs (g) locate in slots (f) and the unit 1 has the completed form shown in FIGS. 4–6 and is ready for use, the outer sleeve 8 now folded by the pushing up process to provide stabilizing side extensions 42.

Figure 10:
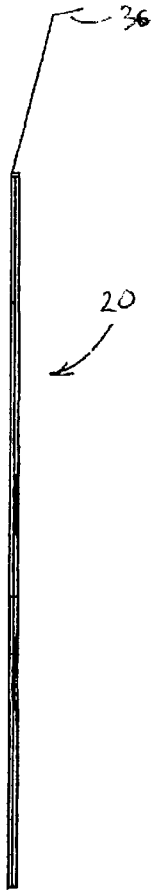
FIG. 10 is an edge (side) elevation of an assembled product dispensing unit according to the invention in a flattened state.
Figure 11:
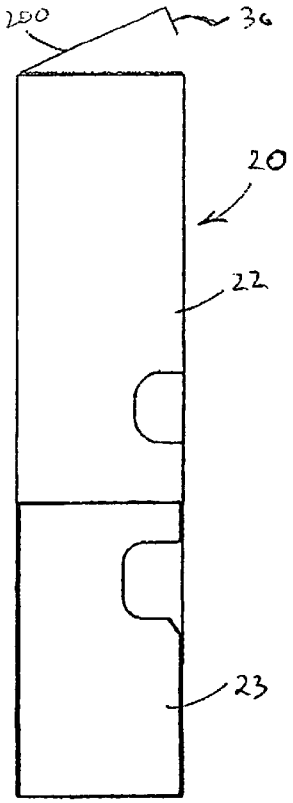
FIG. 11 is a side elevation of the product dispensing unit of FIG. 10 in a partially assembled condition.
Figure 12:
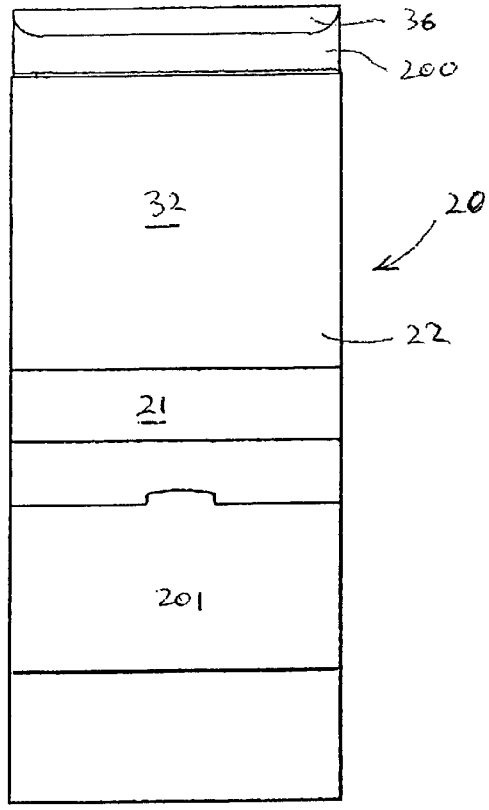
FIG. 12 is a front elevation of the product dispensing unit of FIG. 10, in a partially assembled condition.
Figure 13:
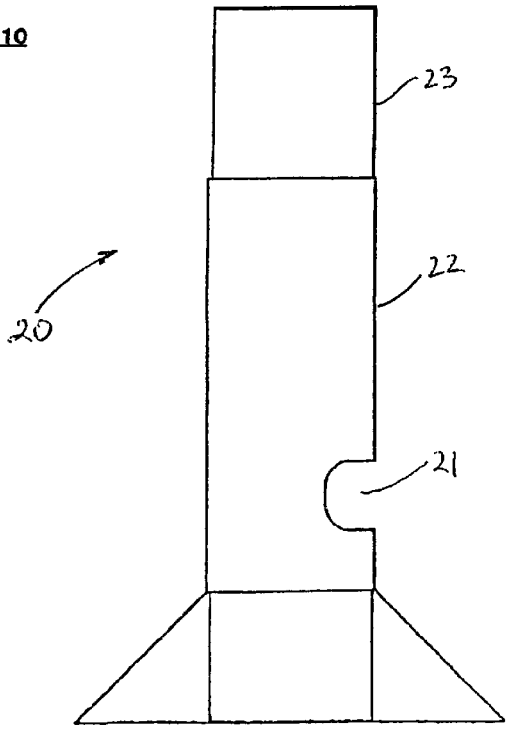
FIG. 13 is a side elevation of the product dispensing unit of FIG. 10, in a fully assembled condition.
Figure 14:
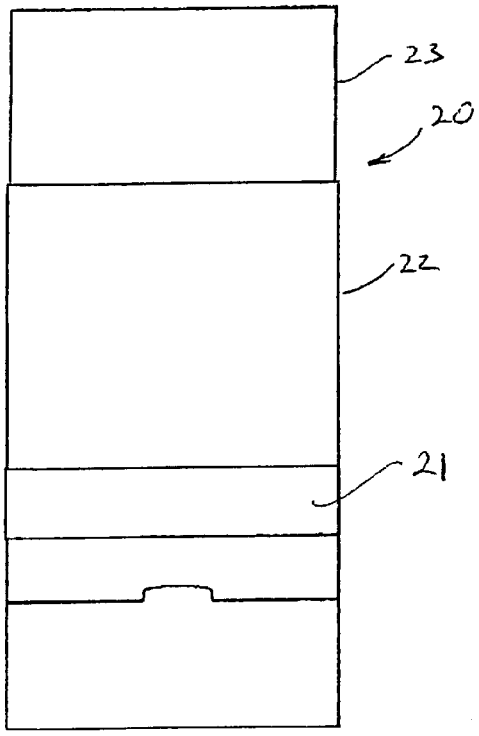
FIG. 14 is a front elevation of the fully erected product dispensing unit of FIG. 13.

There will now be described a pop-up gravity-fed dispensing unit 20 according to the invention in another aspect. This is similar to the brochure display unit 1 in being made from two cardboard (or similar) blanks, one of which forms an outer sleeve 22 and the other of which forms an inner base 23. Also similarly, the dispensing unit 20 can be laid flat for storage and transport and then easily erected when required. The inner base 23 is in effect a closed-top box which contains products. These fall under gravity towards, and can be removed from, a side slot 21 in the erected unit 20. FIGS. 10 to 14 show various views of the dispensing unit 20, from its initially-assembled and collapsed flat state (shown in FIG. 10) to fully erect (FIGS. 13–16). It can be seen in FIG. 10 that the collapsed flat unit 20 takes up little space. FIG. 11 shows the unit 20 side on in a partially-erected state and FIG. 12 shows it in the same state, from the front. FIG. 13 shows the popped-up (i.e. fully erected) unit with dispensing slot 21 and FIG. 14 shows the unit 20 in this state, now from the front.

Figure 15:
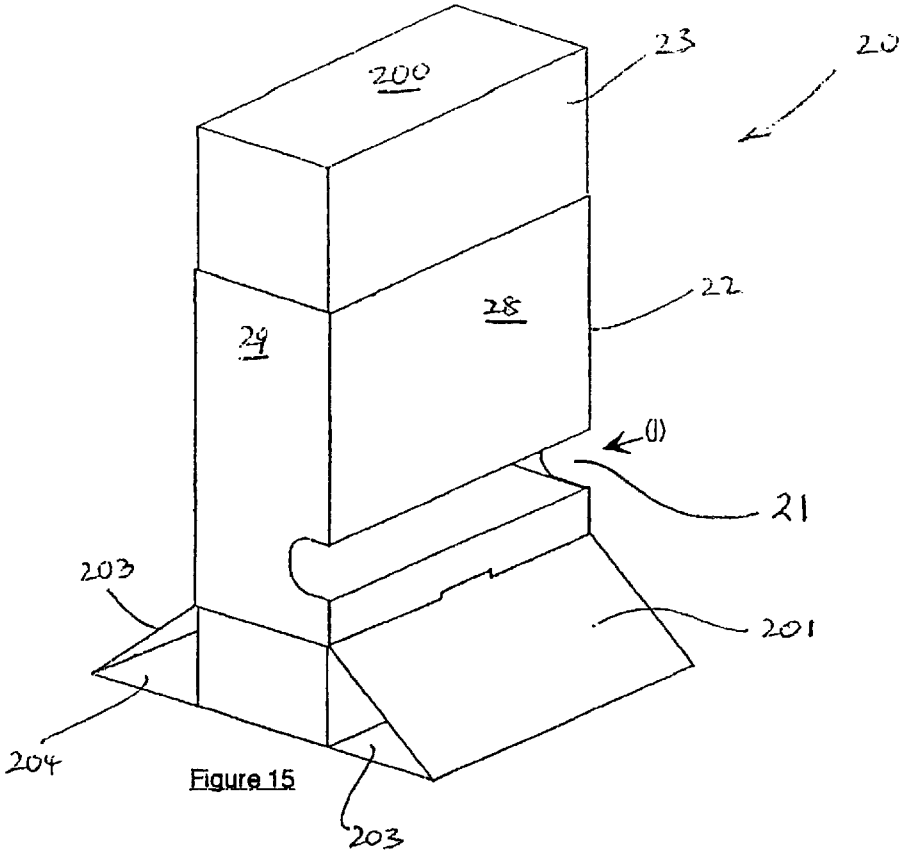
FIG. 15 is an isometric view of the fully-erected product dispensing unit of FIG. 13.
Figure 16:
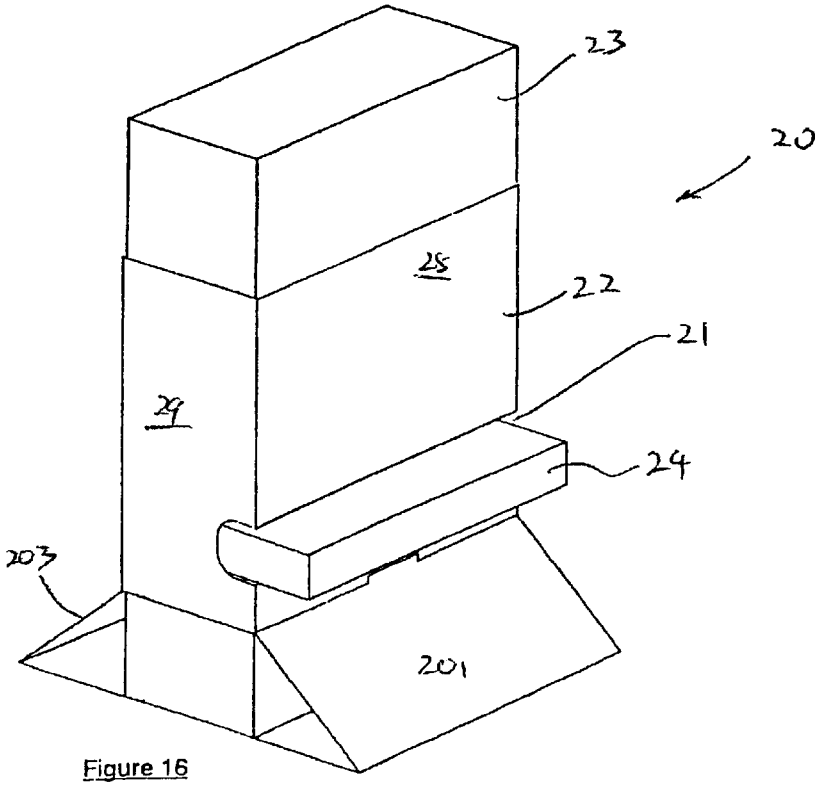
FIG. 16 is an isometric view of the fully-erected product dispensing unit of FIG. 13 with a product partially dispensed therefrom.

FIGS. 15 and 16 are isometric views of the dispensing unit 20, both empty (FIG. 15) and showing a box of product 24 emerging from the dispensing slot 21 (FIG. 16).

Figure 18:
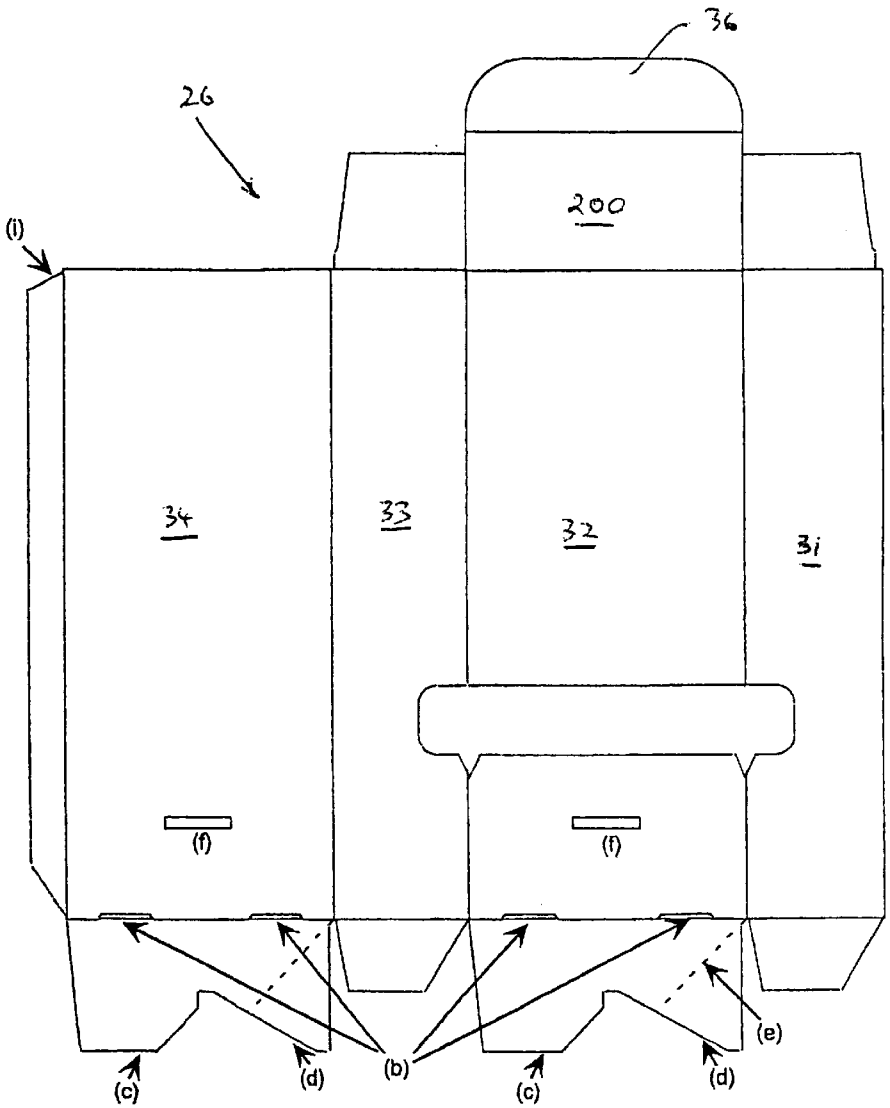
FIG. 18 is an elevation of a bottom inner base blank for the pop-up brochure display unit of FIG. 10, shown unfolded.
Figure 17:
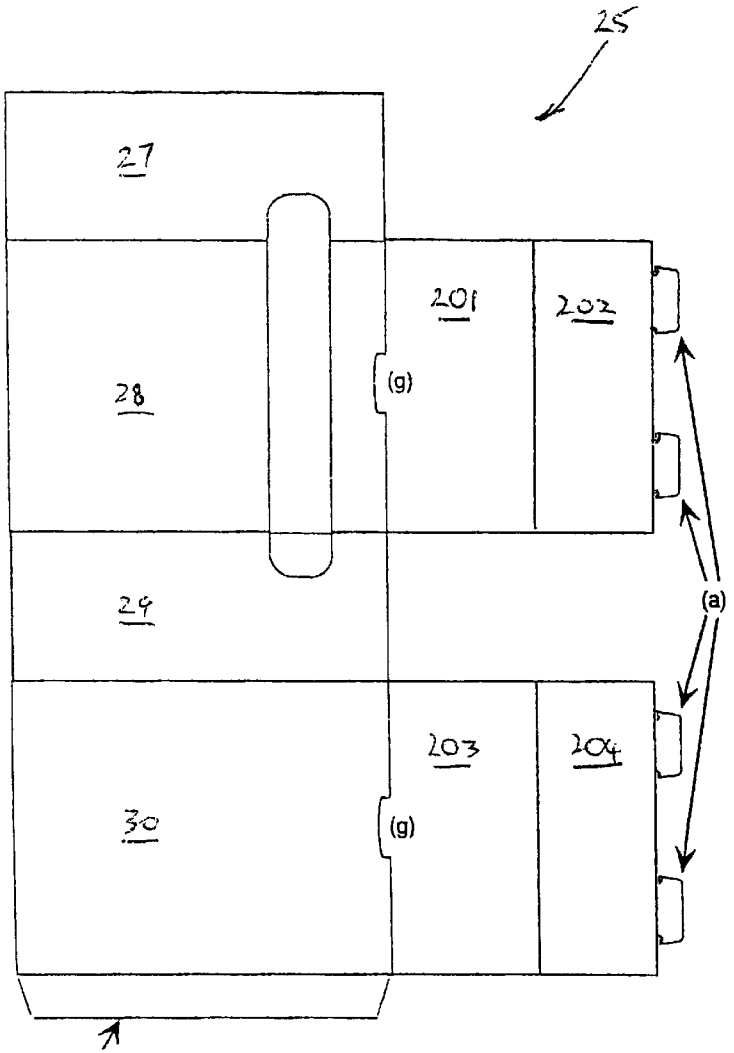
FIG. 17 is an elevation of an outer sleeve blank for the pop-up brochure display unit of FIG. 10, shown unfolded.

FIG. 17 shows the outer sleeve blank 25 from which the outer sleeve 22 is formed. FIG. 18 shows the inner base blank 26 from which the inner base 23 is formed. Slotted locking tabs (a) are shown on blank 25, and these insert, during initial assembly of the unit 20, into slots (b) in blank 26. (An alternative arrangement to these tabs and slots is shown and described in FIGS. 21 and 22.) Also shown in FIG. 17 are location tabs (g) which, when the unit 20 is erected for use, locate in slots (f) in inner base 23—these slots can be seen in blank 26. The glue flap (h) for in-line gluing is shown on the blank.

FIG. 18 shows the inner base blank for the pop-up product dispenser unit, which is designed to form a crash-lock bottom when in use, in a manner known to persons skilled in the art. Shown also in FIG. 18 is a wide (maximum width) flap (c) for added strength, and an angled cut (d) which allows for a wider-than-usual and therefore stronger hinge mechanism (e) as well as a general strengthening of the bottom area. (Conventional crash-lock bottom designs use a straight cut at (d) and, in a shallow but wide box, there is a tendency for weakness that can result in failure of the integrity of the box's bottom).

Blank 25 has a glue flap (h) which when the blank 25 has been formed is line-glued to a section 27 so that on erection of the unit 20, sections 27, 28, 29 and 30 form sides of the outer sleeve 22. Similarly, Blank 26 has a glue flap (i) which when the blank 26 has been formed is line glued to a section 31 so that on erection of the unit 20, sections 31, 32, 33 and 34 form sides of inner base 23.

When the blanks 25 and 26 have been formed and their flaps (h) and (i) glued in their respective positions, they are assembled together with the inner base 23 inside the outer sleeve 22, tabs (a) in slots (b), and crash-lock base sections 35 between sections 28 and 30. At this stage, the sleeve 22 and the inner base 23 can lie flat as shown in FIG. 10, for convenient transport in empty condition. Lid flap 36 is left clear, as shown in FIG. 10, at this stage. When the unit 20 is to be readied for use, outer edges of the flattened assembly of unit 20 are pushed together, so that the inner base 23 assumes its box shape, and the sleeve 22 surrounds it. At this stage, shown in FIGS. 11 and 12, the crash-lock bottom is automatically formed, as known in the art. To finally erect the unit 20, the inner base unit 23 is then pushed upwards within the sleeve 22, until tabs (g) locate in slots (f) and the unit 20 has the completed form shown in FIGS. 13–16 and is ready for use.

Figure 19:
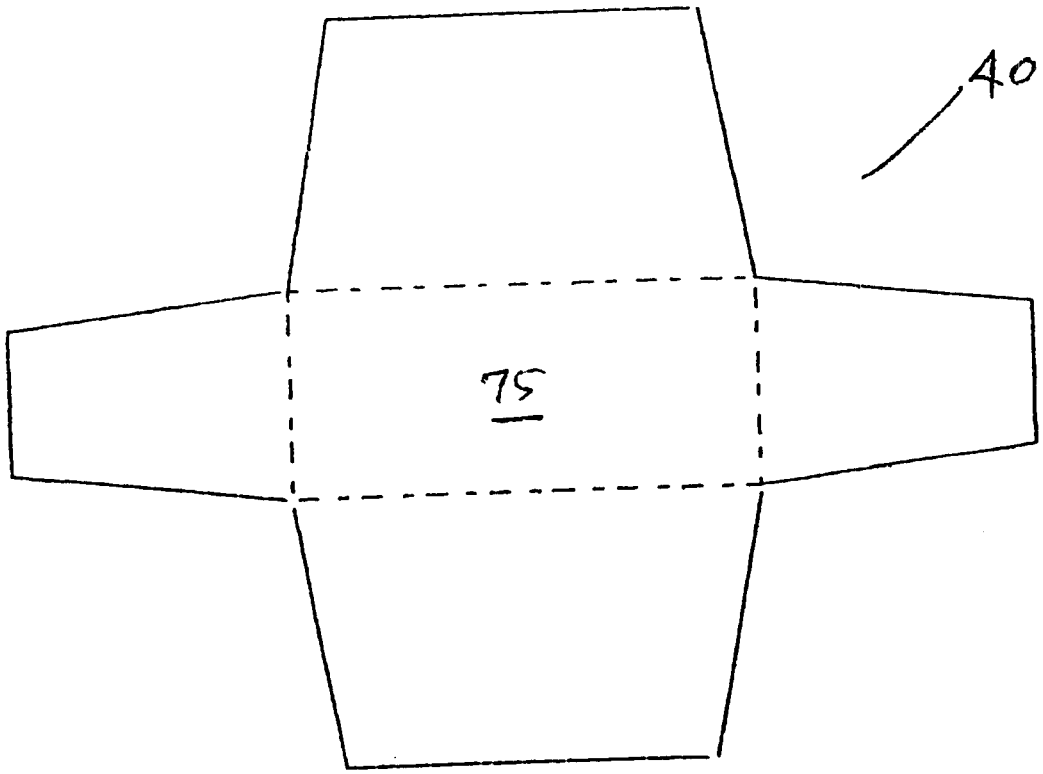
FIG. 19 is an elevation of a blank for a base insert for the product dispensing unit of FIG. 10, shown unfolded.

FIG. 19 shows a simple base insert blank 40 for use in the product-dispensing unit 20. When folded to shape and inserted in the inner base 23 of the erected dispensing unit 20, section 75 of the insert 40 forms a supportive base at the correct level to enable product to be removed from the slot 21 of the dispenser. The insert base piece 40 can be die cut from the same sheet as the main components (25, 26) or from a separate material such as corrugated board if extra strength is required.

Figure 20:
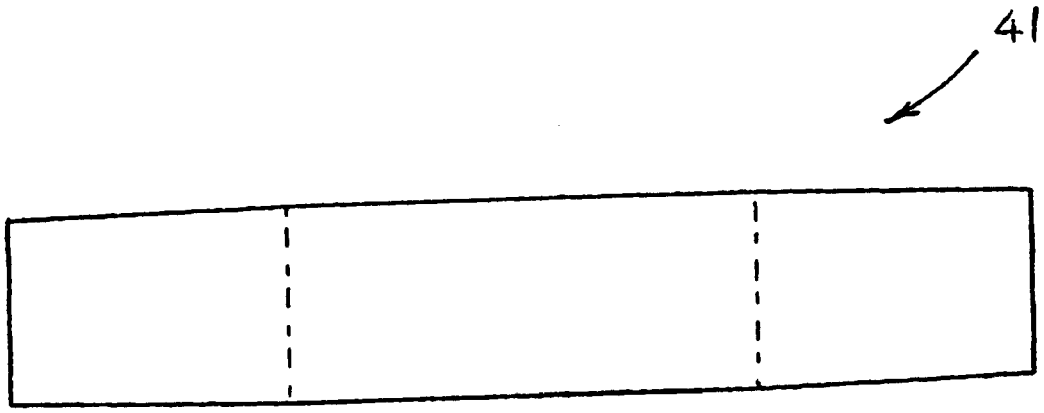
FIG. 20 is an elevation of a blank for an alternative base insert for the product dispensing unit of FIG. 10, shown unfolded.

An alternative base insert blank 41 is shown in FIG. 20, and may be suitable for light products. Other forms of product base may also be employed, using either off-cuts from the die cut cardboard sheet or by creating, in the inner box, tabs which, when formed at 90 degrees, allow a flat base to sit securely inside the unit. Other means of achieving a base support, including glued flaps or extended flaps incorporated in the blank which fold to form the required base, also form part of this invention. (See FIGS. 23 and 24, further discussed below.)

The units 1 and 20 have been shown with crash-lock bottoms. However, it will be recognised by persons skilled in the art that various alternative arrangements are possible for forming bottoms, such as snap-type bottoms which require an assembly step after unflattening of the units (1 or 20) from their storage/transport condition to define a bottom.

Figure 21:
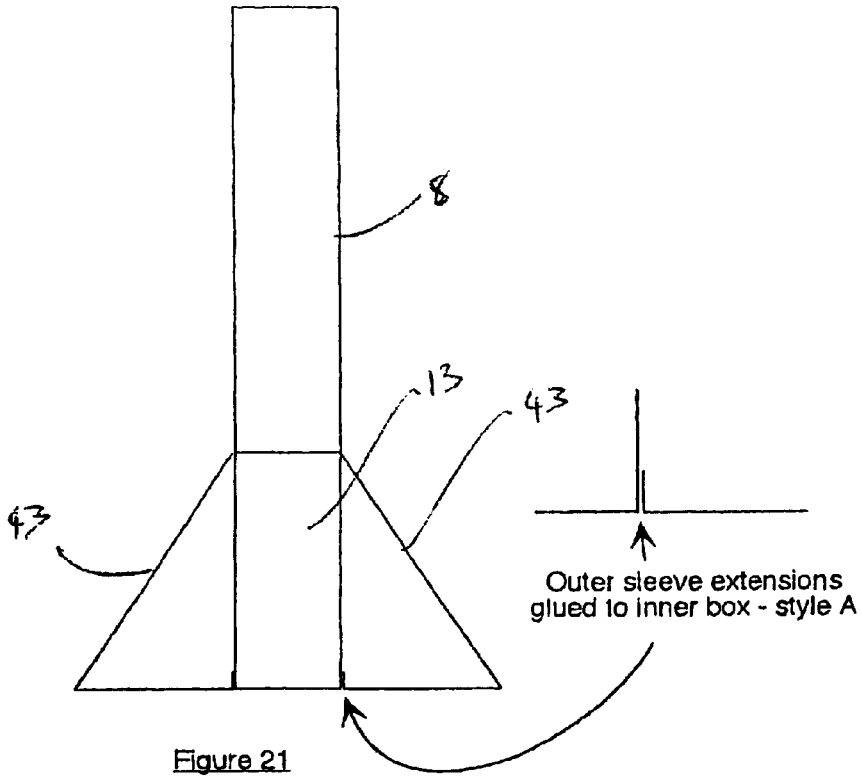
FIG. 21 is a side elevation of an alternative version of the brochure display unit of FIG. 4, shown in a fully erected condition.
Figure 22:
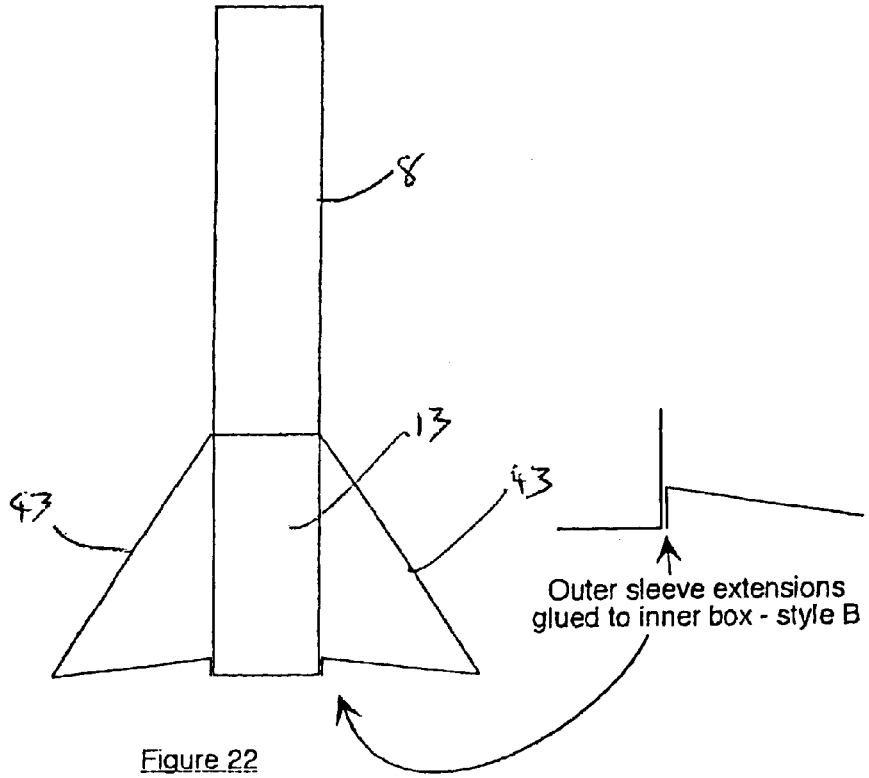
FIG. 22 is a side elevation of a further alternative version of the brochure display unit of FIG. 4, shown in a fully erected condition.
Figure 25:
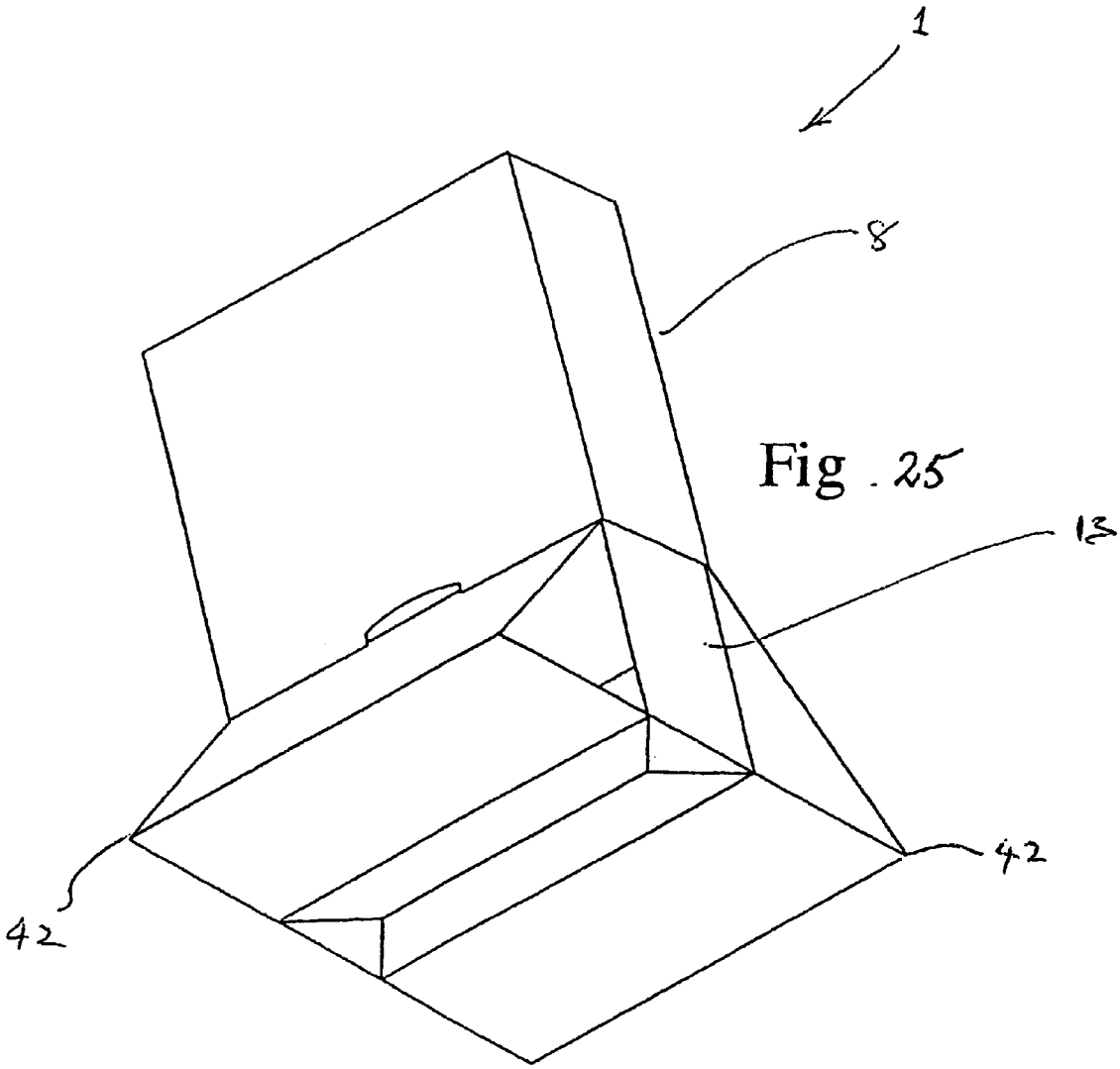
FIG. 25 is an isometric view, from below, of the brochure display unit as shown in FIGS. 21 & 22.

FIGS. 21 and 22 show alternative ways that side extensions to the outer sleeve unit 8, similar to those 42 shown in FIG. 4, can be attached to the inner box 13 of the brochure display unit 1, by gluing. Glued side extensions 43, 43*a* are alternatives to the tab-in-slot arrangement indicated in FIGS. 8 and 9 (for the brochure holder 1) and FIGS. 17 and 18 (for the product dispenser). These glued side-extensions 43, 43*a* as described are appropriate where the tabs (a) of FIG. 8 are replaced with widened tabs traversing the entire width of the edge from which the tabs (a) protrude. FIG. 25 is an isometric view from below, of the brochure display unit 1, in the form described above with reference to FIGS. 21 & 22. The same principle for making the side extensions can be applied to the display unit 20 also.

Figure 23:
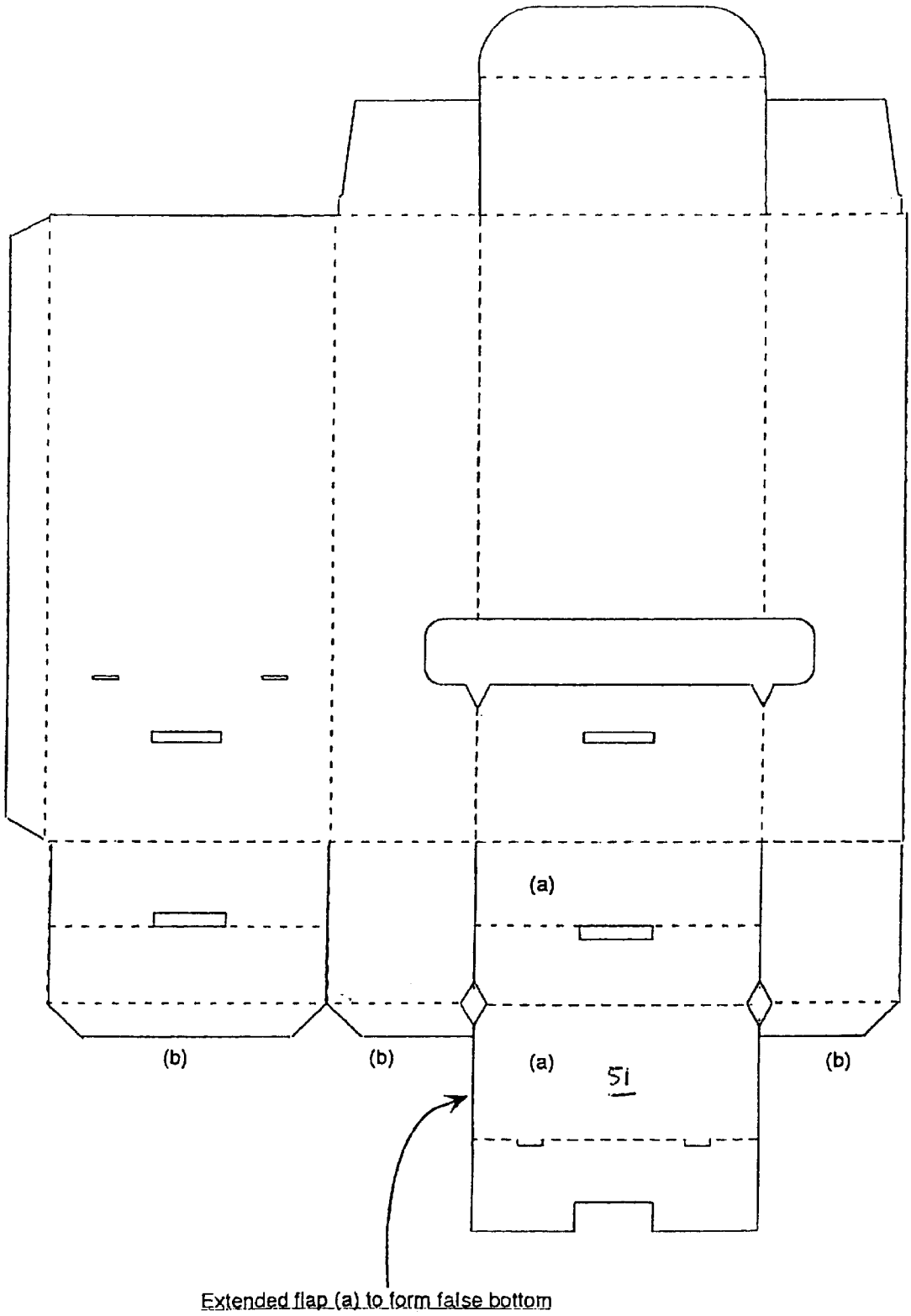
FIG. 23 is an elevation of a bottom inner base blank for an alternative product dispensing unit according to the invention, shown unfolded.

FIG. 23 shows an alternative inner base construction blank 50 for the product dispensing unit 20 where an extended bottom flap 51 is provided and in use folds up inside the base 23, locking with the aid of the other flaps ((b) in FIG. 23) when they are folded up inside, to form a false bottom at the correct position to enable product to be withdrawn from the dispensing slot 21. The outer sleeve 22 can then either be of a style similar to that shown in FIGS. 13, 15 and 16 or have glued extensions similar to extensions 43 shown in FIGS. 21 & 22.

Figure 24:
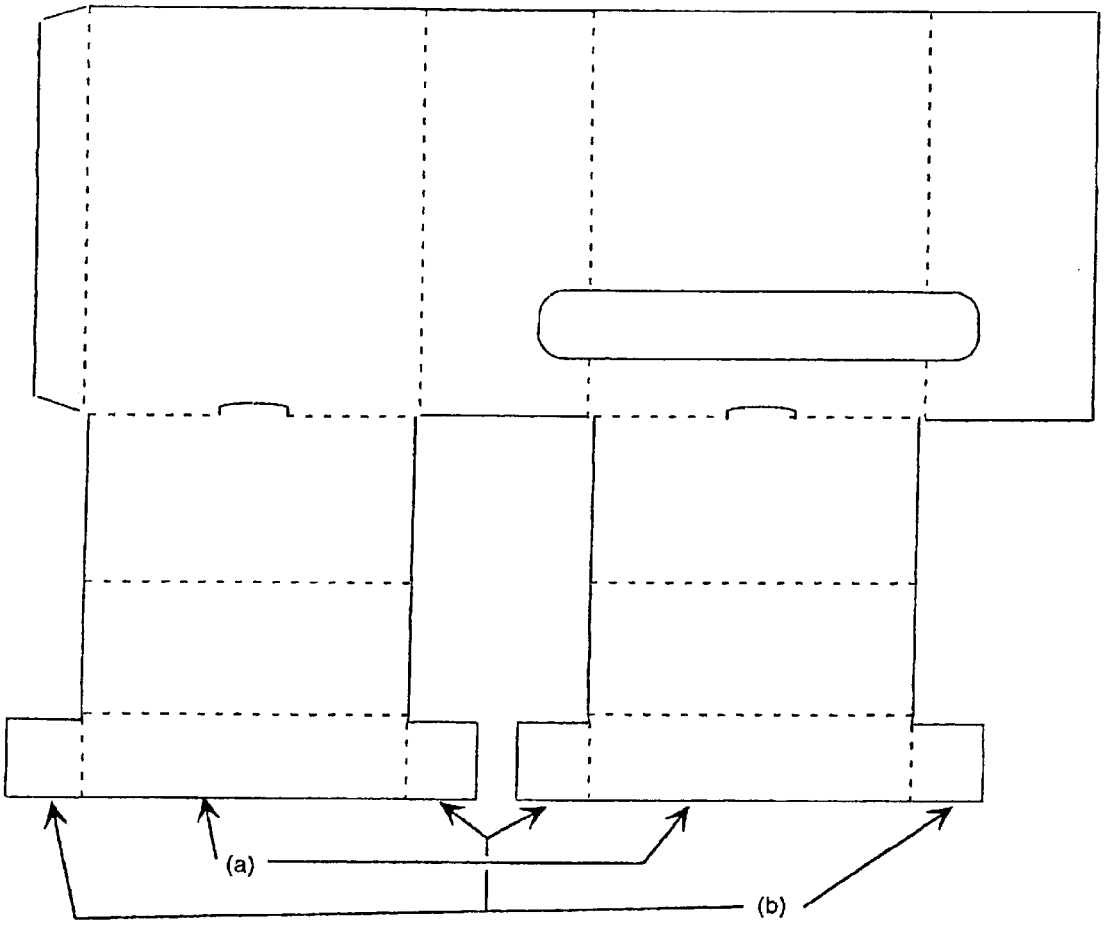
FIG. 24 is an elevation of an outer sleeve blank for use with the inner base blank shown in FIG. 23.

FIG. 24 shows an alternative outer sleeve blank 60 for use in a dispensing unit when extended flaps are used, as in FIG. 23, to form a false bottom. The lengthened extensions marked (a) and side flaps marked (b) in this Figure enable these parts to lock under the folded-in flaps of the false bottom on the inner box.

Certain item numbers not discussed above are shown in the Figures simply to assist in understanding of the way the blanks 2, 3, 25, 26 are folded and assembled to produce the units 1 and 20. They do not refer to faces, but to sections of their respective blanks defined by edges and/or fold lines, so that one of these numbers when shown in an assembly drawing may show the same or an opposite face to that marked with the number in a view of the correspond unfolded blank.

What is claimed is:

1. A display unit for displaying and/or dispensing items, including a sleeve part and a container part, wherein:

a) said sleeve part is formed from a first shaped blank having four sleeve panel sections foldable about four substantially parallel first fold lines, and four outrigger panel sections foldable about two substantially parallel second fold lines that extend perpendicular to the first fold lines, one pair of said outrigger panel sections being connected to an associated one of said sleeve panel sections, the first blank being movable between a first condition in which said sleeve panel sections define a sleeve of rectangular cross section in a plane perpendicular to said first fold lines and a second condition in which said sleeve panel sections lie substantially flat in parallel planes;

b) said container part is formed from a second shaped blank having four container panel sections foldable about four substantially parallel third fold lines, and base flaps, one each associated with each of said container panel sections and foldable about fourth fold lines that extend perpendicular to the third fold lines, the second blank being movable between a first condition in which said container panel sections define a container of rectangular cross section in a plane perpendicular to said third fold lines and a second condition in which said container panel sections lie substantially flat in parallel planes;

c) said container part is slidably received within said sleeve part such that the first fold lines and the third fold lines at respective edges between adjoining ones of said sleeve and container panel sections substantially coincide; and d) said sleeve part and said container part are secured to each other in that one of said outrigger panel sections of each pair is secured to a base portion of the container part and such that, when said container and sleeve parts are in the second condition, relative displacement of the sleeve part towards the base portion of the container part causes said outrigger panel sections of said sleeve part to fold about said second fold lines and said outrigger panel sections attain a position defining outrigger feet protruding traversely from said sleeve part.

2. A display unit according to claim 1, wherein the sleeve part has at least two securing tabs, one each formed at a free terminal edge of an associated outrigger panel section pair, the tabs being secured in fixed manner permanently or temporarily to the container part base portion.

3. A display unit according to claim 2, wherein the container part base portion comprises two of the container panel sections which, in the second condition, are parallel, spaced to one another.

4. A display unit according to claim 3, wherein the securing tabs are glued to the respectively opposite one of said container panel sections, and wherein a fifth fold line is defined between each of said tabs and the respectively adjoining outrigger panel section thereby to permit folding of said securing tabs relative to said outrigger panel section.

5. A display unit according to claim 3, wherein the container part base portion comprises slots arranged to cooperate with and receive the securing tabs.

6. A display unit according to claim 5, wherein the slots and tabs are self-locking in configuration.

7. A display unit according to claim 1, further including position locking members at the sleeve and container parts that are operatively arranged to engage with one another to secure an in-use position of said sleeve part and said container part in which the outrigger feet are formed and in which further sliding of said sleeve part with respect to said container part in a direction away from its base portion is prevented.

8. A display unit according to claim 7, wherein said position locking members consist of at least one position locking tab on one of said sleeve part and said container part and at least one cooperating slot on the other of said sleeve part and said container part.

9. A display unit according to claim 8, wherein at least two of said position locking tabs are formed at said sleeve part and corresponding slots are provided in said container part panel sections.

10. A display unit according to claim 9, wherein the position locking tabs are formed by partially cut tongues cut-out in these sleeve panel sections associated with the outrigger panel sections, the partially cut tongues being arranged to remain in substantially the same plane as the adjoining outrigger panel section upon folding of said outrigger panel sections about the second fold lines and with respect to the adjoining sleeve panel sections.

11. A display unit according to claim 1, wherein the base flaps are configured to provide a crash-lock bottom of said container part when in said second condition.

12. A display unit according to claim 1, wherein the first and the second shaped blanks each have at least one gluing tab formed in parallel extension of an associated panel section such that a single gluing line is provided to form the flatenable sleeve and container parts.

13. A display unit according to claim 1, wherein said container part, with folded and closed base flaps in said first condition, is open-topped.

14. A display unit according to claim 1, wherein the first and second blanks have a contour and pre-scored fold lines.

15. A display unit according to claim 14, wherein the sleeve part blank is folded into an outer sleeve unit by folding along all the depicted pre-scored lines and wherein a gluing tab (h) is placed behind the associated one said sleeve panel sections opposite said gluing tab and glued in this position.

16. A display unit according to claim 14, wherein the container part blank is folded into an inner base unit by folding along all the depicted pre-scored lines, and wherein a gluing tab is placed behind the associated one of said container panel sections opposite said gluing tab and glued in this position.

17. A display unit according to claim 1, wherein the sleeve and container part blanks are made of carton or cardboard.

18. The display unit according to claim 5, wherein the sleeve part blank is printed with information material.

* * * * *